US008371466B2

(12) United States Patent
Phillips et al.

(10) Patent No.: US 8,371,466 B2
(45) Date of Patent: Feb. 12, 2013

(54) BEVERAGE CAN MULTI-FUNCTIONAL TOOL

(75) Inventors: Stephen Andrew Phillips, Overland Park, KS (US); Krishnan Paranjothi, Lawrence, KS (US)

(73) Assignee: My Can Your Can LLC, Lawrence, KS (US)

( * ) Notice: Subject to any disclaimer, the term of this patent is extended or adjusted under 35 U.S.C. 154(b) by 211 days.

(21) Appl. No.: 12/781,470

(22) Filed: May 17, 2010

(65) Prior Publication Data

US 2011/0006064 A1 Jan. 13, 2011

Related U.S. Application Data

(60) Provisional application No. 61/223,464, filed on Jul. 7, 2009.

(51) Int. Cl.

| | |
|---|---|
| ***B65D 17/34*** | (2006.01) |
| ***B65D 43/18*** | (2006.01) |
| ***B65D 39/00*** | (2006.01) |
| ***B65D 41/00*** | (2006.01) |
| ***B65D 43/00*** | (2006.01) |
| ***B65D 47/00*** | (2006.01) |
| ***B65D 51/00*** | (2006.01) |
| ***B65D 23/12*** | (2006.01) |

(52) U.S. Cl. ..... 220/269; 220/821; 220/906; 215/230; 215/255; 215/391

(58) Field of Classification Search ..... 220/269, 220/821, 906; 215/230, 255, 391
See application file for complete search history.

(56) References Cited

U.S. PATENT DOCUMENTS

| | | | | |
|---|---|---|---|---|
| 4,681,358 | A * | 7/1987 | Smith | 294/15 |
| 5,911,794 | A * | 6/1999 | Nordhoff | 81/3.55 |
| 6,032,816 | A * | 3/2000 | Martin | 220/212 |
| 7,089,825 | B2 * | 8/2006 | Klosterman | 81/3.55 |

* cited by examiner

*Primary Examiner* — Anthony Stashick
*Assistant Examiner* — Andrew T Kirsch
(74) *Attorney, Agent, or Firm* — Lathrop & Gage LLP

(57) ABSTRACT

A device and methods for opening a can with a pull tab are disclosed. The device has a forward portion having a top wall and a bottom wall forming a cavity between the walls. The cavity is configured to receive the pull tab. A rear portion extends from the forward portion. The rear portion has a proximal sidewall, a distal sidewall, and a curved groove adjacent the distal sidewall. The curved groove is configured to snap onto a lip of the can. A recessed portion extends from the rear portion distal sidewall. The recessed portion can be lifted to open the can.

19 Claims, 3 Drawing Sheets

SECTION A-A

BEVERAGE CAN MULTI-FUNCTIONAL TOOL

CROSS-REFERENCE TO RELATED APPLICATIONS

This application claims priority to U.S. Provisional Patent Application Ser. No. 61/223,464 filed Jul. 7, 2009, the disclosure of which is incorporated herein by reference.

BACKGROUND OF THE INVENTION

The invention relates generally to the field of can openers. More specifically, the invention relates to devices that can aid in opening cans having pull tab openers.

SUMMARY

Devices for opening cans having pull tabs are set forth herein. According to one embodiment, a device for opening and closing a can with a pull tab includes a forward portion and a rear portion. The forward portion has a top wall and a bottom wall. A cavity is formed between the top and bottom walls. The cavity is configured to receive the pull tab of the can. The rear portion extends from the forward portion. The rear portion has a proximal sidewall and a distal sidewall. The rear portion has a curved groove adjacent the distal sidewall. The curved groove is configured to snap onto a lip of the can. A recessed portion extends from the distal wall of the rear portion.

According to another embodiment, a device for opening and closing a can with a pull tab device includes a top portion and a bottom portion. The can has a top side with a tear panel for providing access to the contents of the can. The can top side has a pull tab for rupturing the tear panel. The pull tab has front and back ends and is attached to the can top side by a rivet. The rivet is closer to the back end of the pull tab than the front end. The pull tab back end is initially adjacent the tear panel, such that when the pull tab front end is lifted away from the can top side, the pull tab back end pushes the tear panel into the can. A hole is formed by the rupturing of the tear panel, and the contents of the can may be accessed through this hole. The pull tab is rotatable around the rivet, allowing the pull tab to rotate at least 180 degrees and the pull tab front end to selectively be upwardly adjacent the hole. The claimed device may be used to open and close the can. A cavity is formed between the top and bottom portions of the opening/closing device. The bottom portion has an indentation that is complimentary to the rivet. The cavity has a front side, a back side, a first lateral side, and a second lateral side. The opening/closing device includes an intermediate wall having a J-shaped cross-section. The intermediate wall has a proximal side and a distal side. The proximal side closes the first lateral side and the back side of the cavity. The proximal side partially closes the second lateral side of the cavity. The cavity is configured to receive the pull tab front end. The intermediate wall has a curved groove adjacent the distal side. The curved groove is configured to snap onto a lip of the can. A recessed portion extends from the distal side of the intermediate wall. The bottom portion is configured to lift the pull tab front end when the pull tab front end is received in the cavity and the recessed portion is raised to open the can. The bottom portion and the intermediate wall are collectively configured to cover the can hole when the pull tab front end is received in the cavity and the pull tab front end of the opened can is rotated to be upwardly adjacent the hole.

According to still another embodiment, a device for opening a can with a pull tab includes a top portion and a bottom portion. The can has a top side with a tear panel rupturable by the pull tab for providing access to the contents of the can. The pull tab has front and back ends and is attached to the can top side by a rivet. The rivet is closer to the back end of the pull tab than the front end. The pull tab back end is adjacent the tear panel, such that when the pull tab front end is lifted, the pull tab back end pushes the tear panel into the can, opening the can and forming a hole. A user may access a beverage within the can from the hole. A cavity is formed between the top and bottom portions of the opening device. The bottom portion has an indentation that is complimentary to the rivet. The opening device includes an intermediate wall with a curved groove configured to snap onto a lip of the can. A recessed portion is coupled to the intermediate wall. The cavity is configured to receive the pull tab front end, and the bottom portion is configured to lift the pull tab front end when the pull tab front end is received in the cavity and the recessed portion is raised. The recessed portion is lower than the top portion to prevent the user from hitting the user's nose with the device when consuming the beverage within the can while the curved groove is snapped onto the can lip.

BRIEF DESCRIPTION OF THE SEVERAL VIEWS OF THE DRAWINGS

Illustrative embodiments of the present invention are described in detail below with reference to the attached drawing figures, wherein.

DETAILED DESCRIPTION

Figure 2:
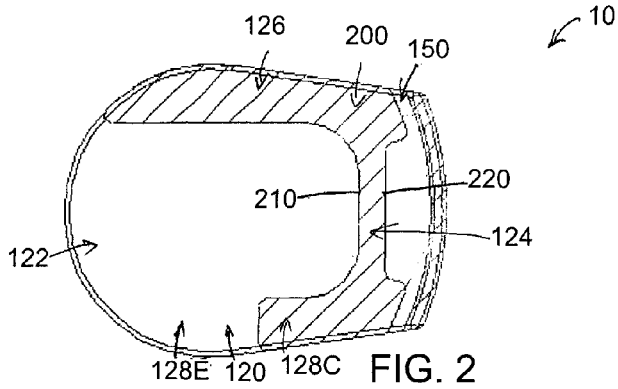
FIG. 2 is a cross-sectional view of the multi-functional tool of FIG. 1.
Figure 6:
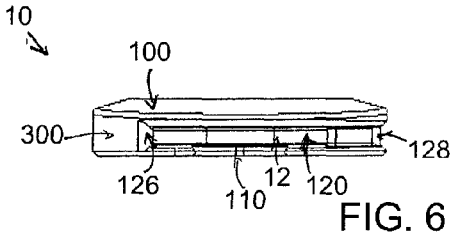
FIG. 6 is a font view showing a cavity in the multi-functional tool of FIG. 1.
Figure 1:
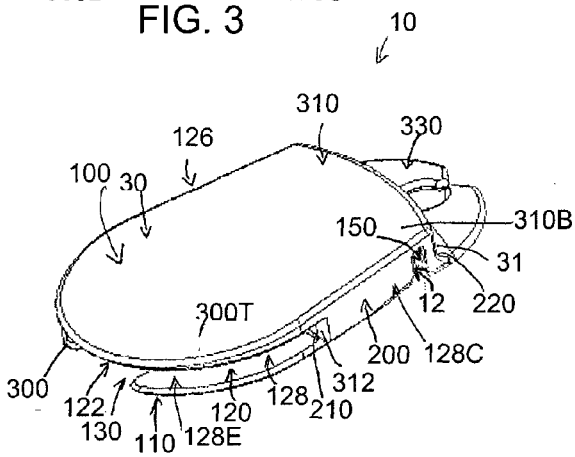
FIG. 1 is a perspective view of a multi-functional tool.

Devices and methods for opening and closing a can having a pull tab are set forth herein. FIGS. 1 through 6 show a beverage can multi-functional device 10. The device 10 has a top portion 100 and a bottom portion 110, and a cavity 120 is formed between the top portion 100 and the bottom portion 110. The cavity 120 has a front side 122, a back side 124, a first lateral side 126, and a second lateral side 128, as shown in FIG. 2. A forward portion 300 of the device 10 has a top wall 300T (FIG. 5) and a bottom wall 300B (FIG. 4). The cavity 120 is formed between the forward portion top wall 300T and the forward portion bottom wall 300B. A rear portion 310 extends from the forward portion 300 and has a proximal sidewall 312, a distal sidewall 314, and a top wall 310B, as shown in FIG. 1. A recessed portion 330 extends from the rear portion distal sidewall 314.

The forward portion 300, the rear portion 310, and the recessed portion 330 may be of a unitary (i.e., one piece) construction. Or, different parts of the device 10 may be made out of different materials; for example, the forward and rear portions 300, 310 may be made out of plastic, while the recessed portion 330 may be made out of wood. Other appropriate materials may include rubber, metal, or stone, for example. It may be desirable for the device 10 to be dishwasher safe, recyclable, or have other properties that may affect material selection.

An intermediate wall 200 separates the top portion 100 and the bottom portion 110. As shown in FIG. 2, the intermediate wall 200 has a J-shaped cross-section. Though not specifically shown in the drawings, the intermediate wall 200 may have a different shaped cross-section; for example, the intermediate wall 200 may be a cylindrical pillar that separates and maintains a gap between the top and bottom portions 100, 110. The intermediate wall 200 shown in the drawings has a proximal side 210 and a distal side 220, and the recessed portion 330 extends from the intermediate wall distal side 220. It may be desirable for the recessed portion 330 to be lower than the top portion 100, and the recessed portion 330 may be as low or lower than the bottom portion 110.

Figure 3:
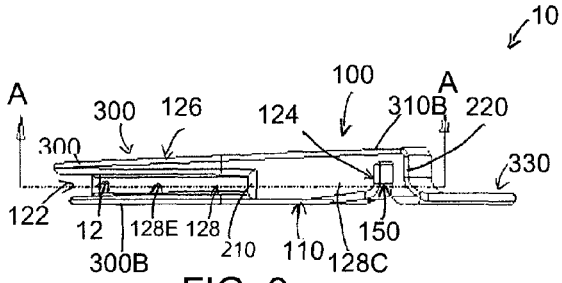
FIG. 3 is a side view of the multi-functional tool of FIG. 1.
Figure 4:
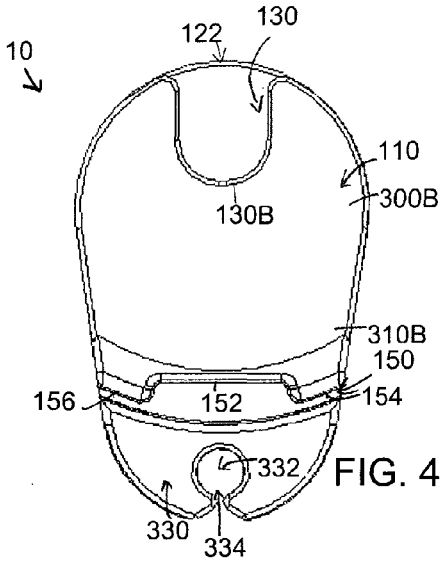
FIG. 4 is a bottom view of the multi-functional tool of FIG. 1.

As shown in FIGS. 1 through 3, the intermediate wall proximal side 210 closes the cavity first lateral side 126 and the cavity back side 124. The intermediate wall proximal side 210 partially closes a portion 128C of the cavity second lateral side 128, while the rest 128E of the cavity second lateral side 128 remains exposed. An object can be inserted into the cavity 120 from the exposed portion of the cavity second lateral side 128E. Similarly, the cavity front side 122 is open such that an object can be received into the cavity 120 from the cavity front side 122.

Figure 7:
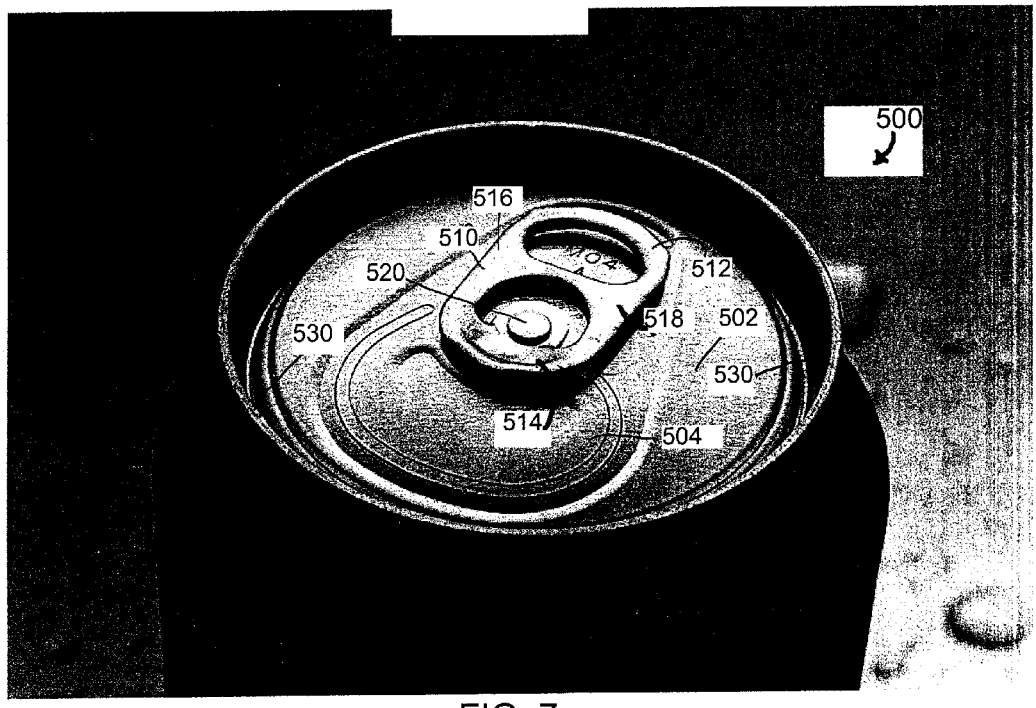
FIG. 7 PRIOR ART
FIG. 7 is a top perspective view of a closed PRIOR ART can.

The intermediate wall 200 has a curved groove 150 that is adjacent the intermediate wall distal side 220 and the rear portion distal sidewall 314. The curved groove 150 is configured so that it can snap onto a lip 530 of a can 500 (FIG. 7). As shown in FIG. 4, the curved groove 150 may include a relief 152 that defines two tabs 154 and 156. The two tabs 154, 156 are on either side of the relief 152 and at opposite ends of the groove 150.

As shown in FIGS. 1 and 4, the bottom portion 110 and the forward portion bottom wall 300B include an indentation 130 having a back side 130B. The indentation 130 may be U-shaped, and the indentation 130 is configured to be complementary to a rivet 520 of the can 500, as explained further below.

Figure 5:
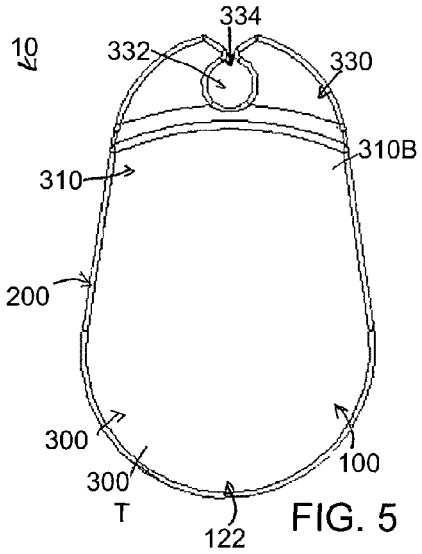
FIG. 5 is a top view of the multi-functional tool of FIG. 1.

The recessed portion 330 has an opening 332 (FIGS. 4 and 5). The opening 332 may be circular, rectangular, oval, or of another regular or irregular shape. A channel 334 in the recessed portion 330 may lead to the opening 332. With the exception of the channel 334, the opening 332 may be enclosed by the recessed portion 330. The device 10 may be coupled to other objects through the channel 334; for example, a key chain or a necklace may pass through the channel 334 and be positioned in the opening 332. The device 10 may similarly be decoupled from other objects using the channel 334. The channel 334 may be of varying diameters. While the channel 334 may be desirable, various embodiments may omit the channel 334 and even the opening 332.

The forward portion 300, the recessed portion 330, the top portion 100, and the bottom portion 110 shown in FIG. 1 are curved from one side to give the device 10 a tear drop shape. Though not shown in the drawings, it is possible for the forward portion 300, the top portion 100, the bottom portion 110, or the recessed portion 330 to not be curved in this manner so that the device 10 has a different shape; for example, the device 10 may be generally shaped as a rectangle, diamond, square, etc.

Figure 9:
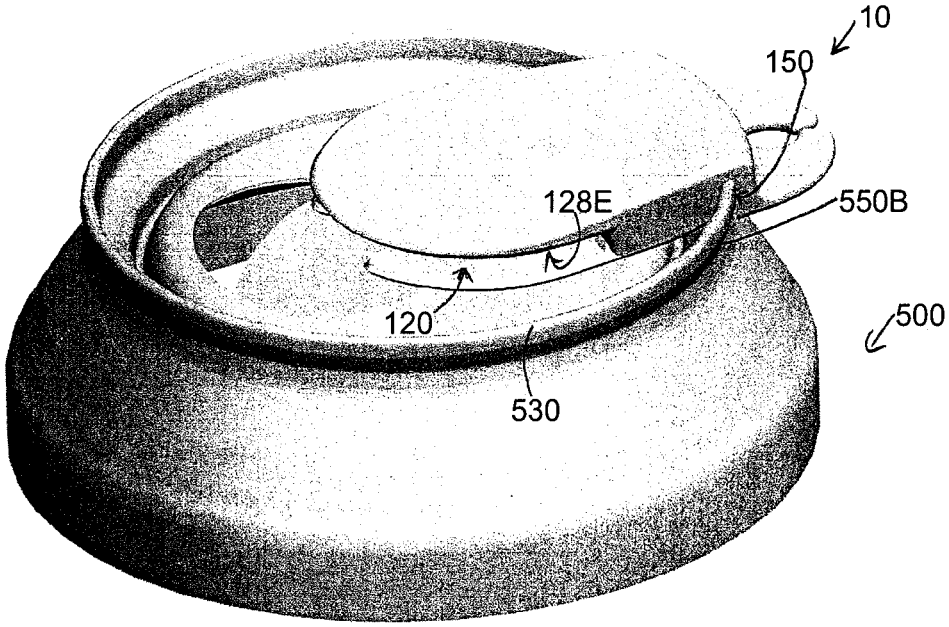
FIG. 9 is a top perspective view of the multi-functional tool of FIG. 1 in use with the PRIOR ART can of FIG. 7.
Figure 8:
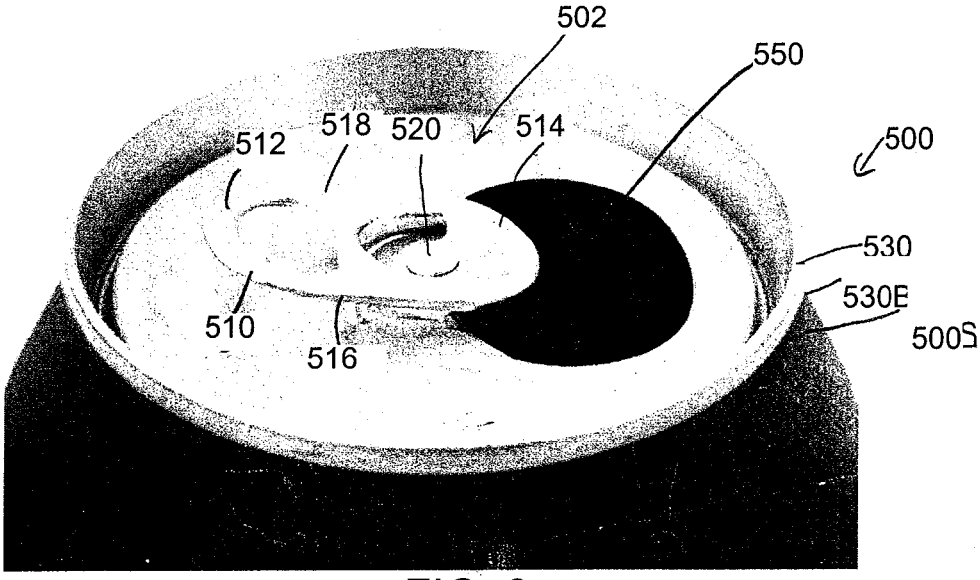
FIG. 8 PRIOR ART
FIG. 8 is a top perspective view of the PRIOR ART can of FIG. 7 with an open tear panel.

The can 500 with which the device 10 is employed is known in the art and is shown in FIGS. 7 through 9. The can 500 has a top side 502 with a tear panel 504 that may be ruptured to provide access to contents of the can 500. A pull tab 510 is utilized to rupture the tear panel 504 and has a front end 512, a back end 514, and two sides 516, 518. The pull tab 510 is attached to the can top side 502 by a rivet 520.

Initially, as shown in FIG. 7, the pull tab front end 512 faces away from the tear panel 504, while the pull tab back end 514 is adjacent the tear panel 504. When the pull tab front end 512 is pulled away from the top side 502, the pull tab back end 514 ruptures the tear panel 504. A hole 550 (FIG. 8) is formed when the tear panel 504 is ruptured. Contents of the can may be accessed by a user through the hole 550.

The can lip 530 surrounds the can top side 502 and is typically formed by a bonding process. The can lip 530 may extend higher than the top side 502 and a can lip bottom side 530B may protrude from a can side 500S.

The pull tab 510 is rotatable around the rivet 520, and the pull tab 510 may be rotated and positioned at different places on the can top end 502. For example, the pull tab 510 may be rotated about 180 degrees from its initial position such that the pull tab front end 512 is atop the can hole 550, while the pull tab back end 514 faces away from the hole 550. Using the pull tab 510 to rupture the tear panel 504 may not inhibit the ability of the pull tab 510 to rotate around the rivet 520.

Attention is now directed to the use of the device 10 with the can 500, as shown in FIG. 9. The device 10 can be slid onto the can pull tab 510 such that all or part of the pull tab 510 is positioned within the device cavity 120. To slide the device 10 onto the pull tab 510, the user may hold the device 10 between the user's thumb and index finger, or between any other fingers that the user is comfortable with. The user may then place the device 10 next to the pull tab 510, such that the exposed portion 128E of the cavity second lateral side 128 is adjacent the pull tab side 516, and the device bottom portion 110 is adjacent the can top side 502. The user may then slide the exposed portion 128E of cavity second lateral side 128 towards the pull tab side 516 until the pull tab 516 is partially surrounded by device cavity 120, and continue sliding the device 10 onto the pull tab 510 until the pull tab side 516 comes into contact with the intermediate wall proximal side 210 and the pull tab front end 512 faces the cavity back side 124. The user may then push the device 10 such that the pull tab front end 512 moves towards the cavity back side 124, and continue pushing until either the indentation back side 130B comes into contact with the can rivet 520, or the pull tab front end 512 comes into contact with the cavity back side 124. All or a part of the recessed portion 330 may be outside the boundary of the can lip 530, while the rest of the device 10 may generally be atop the can top side 502.

Alternatively, to slide the device 10 onto the pull tab 510, the user may place the device 10 such that the cavity front side 122 is adjacent the pull tab front end 512, and the bottom portion 110 is adjacent the can top side 502. The user may then push the device 10 and slide the pull tab front end 512 into the cavity front side 122, until either the indentation back side 130B comes into contact with the can rivet 520, or the pull tab front end 512 comes into contact with the cavity back side 124. It may be easier to slide the device 10 onto the pull tab 510 from the cavity second lateral side 128E than from the cavity front side 122, because there is more space between the can lip 530 and the pull tab side 516, than the can lip 530 and the pull tab front end 512.

After sliding the device 10 onto the pull tab 510, the user may then lift the recessed portion 330. Lifting of the recessed portion 330 may cause the bottom portion 110 to move away from the can top side 502 and lift the pull tab front end 512 inside the cavity 120. Lifting of the pull tab front end 512 may cause the pull tab back end 514 to move downward into the tear panel 504, eventually rupturing the tear panel 504. The tear panel 504 may move into the hole 550 that is formed by the rupturing of the tear panel 504.

Lifting of the recessed portion 330 to rupture the tear panel 504 instead of lifting the pull tab front end 512 may have several advantages. Ordinarily, for example, a user has to first pry the user's index finger, another finger, or a fingernail under the pull tab front end 512 before being able to lift the front end 512. This may be difficult, especially if the pull tab front end 512 is very close to the can top 502. Also, if the user does not have long fingernails or has big fingers, it may be difficult for the user to slide a fingernail or finger under the pull tab front end 512. The device cavity 120 can easily be slid towards the pull tab 510, and the solid recessed portion 330, generally being spaced apart from the top end 502, provides a convenient and easily accessible alternative to the pull tab front end 512. The forward portion bottom wall 300B may be beveled to aid in sliding the pull tab 510 into the device cavity 120. Moreover, the greater length of the device 10 as compared to the pull tab 510 may provide better leverage to open the can 500, such that less force may need to be applied to rupture the tear panel 504. The device 10, therefore, may be especially helpful for people with joint pain in their fingers (e.g., arthritis).

After opening the can 500, the user may snap the curved groove 150 on the can lip 530, as shown in FIG. 9. The curved groove tabs 154, 156 may be such that they are wider at the side closer to the device top portion 100, and narrower at the side adjacent the device bottom portion 110, allowing the curved groove tabs 154, 156 to latch on to the protruding can lip bottom 530B. Snapping of the curved groove 150 on the can lip 530 ensures that the device 10 remains securely in place even if the can 500 is moved or shaken. The relief 152 may allow the curved groove 150 to snap on to different sized can lips 530, and on cans of varying diameters. The recessed portion 330, by being lower than the top portion 100, may prevent the user's nose from contacting the device 10 while the user is consuming the beverage within the can 500 with the device 10 snapped on the can lip 530.

As mentioned above, the pull tab 510 is rotatable around the rivet 520. The device 10 can be rotated along with the pull tab 510 around the rivet 520, notwithstanding the curved groove 150 being snapped onto the can lip 530. Once the can 500 is opened and the curved groove 150 is snapped onto the can lip 530, the device 10 can be rotated about 180 degrees along with pull tab 510 such that the pull tab front end 512 is upwardly adjacent the can hole 550 and the pull tab back end 514 faces away from the can hole 550. Said differently, the device 10 with pull tab 510 can be rotated such that the cavity front end 122 faces away from the hole 550, while the bottom portion 110 is directly atop the can hole 550. As such, the device 10 can be rotated selectively such that the bottom portion 110 and/or the intermediate wall 200 collectively cover the can hole 550 completely or nearly so.

The ability to cover the can hole 550 of an open can 500 may have various advantages. For example, if the can 500 is accidentally tipped over, the device 10 may eliminate or at least limit the contents of the can 500 from spilling out of the can 500. Or, when open cans 500 are placed in cup holders of cars, contents of the uncovered cans 500 often spill out when the car suddenly brakes or goes over a bump in the road. The device 10 may allow the user to eliminate or limit this spillage. Moreover, covering of the can hole 550 may prevent debris, insects, or other unintended objects from entering the can 500. Nevertheless, the can hole 550 may only be partially covered with the bottom portion 110, to provide different sized vents and openings in the can hole 550 for consuming the beverage.

The device 10 may also be used for advertisement; for example, the top portion 100 may include indicia relating to a sponsor. Since the device 10 may be reusable, any indicia relating to a sponsor may potentially be seen repeatedly for years, both by the user and others. Generally, the top side 502 of a can 500 is devoid of any logos or sponsor information. Therefore, the device 10 may provide an eye catching way for sponsors to display advertisements at a can top side 502. Or, the top portion 100 may include a quote or a message, and function akin to a bumper sticker on a car.

Often, at parties or other gatherings, several users may drink the same type of beverage from the same kind of can 500, and their cans 500 may get mixed up, such that it is difficult to determine which can 500 belongs to which user. All or part of the device 10 may be colored, and different devices 10 may be of different colors or have other identifying characteristics, so that users may identify their respective can 500 from a plurality of similar cans 500.

The device 10 disclosed above is designed primarily for use by right-handed users, however, it will be apparent to those skilled in the art that the device 10 may be easily modified for use by left-handed users. To achieve this modification, the intermediate wall proximal side 210 may fully close the cavity second lateral side 128, and instead of completely closing the cavity first lateral side 126, the intermediate wall proximal side 210 may leave the cavity first lateral side 126 partially exposed. In effect, the cavity first lateral side 126 and the cavity second lateral side 128 may be switched.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

The invention claimed is:

1. A device for opening and closing a can with a pull tab, the device comprising:

a forward portion having a top wall and a bottom wall forming a cavity therebetween; the cavity being configured to receive the pull tab; the cavity being accessible by the pull tab at a front end of the cavity; the cavity being accessible by the pull tab at a side of the cavity;

a rear portion extending from the forward portion; the rear portion having a proximal sidewall, a distal sidewall, and a curved groove adjacent the distal sidewall; the curved groove configured to snap onto a lip of the can; and a recessed portion extending from the rear portion distal sidewall.

2. The device in claim 1, wherein the forward portion, the rear portion and the recessed portion have a unitary construction.

3. The device in claim 2, wherein the recessed portion is lower than the top wall when the curved groove snaps onto the can lip and the can is upright.

4. The device in claim 3, wherein:

the bottom wall has an indentation that is complementary to a rivet attaching the pull tab to the can such that the rivet does not prohibit the curved groove from snapping onto the can lip; and the bottom wall is beveled.

5. The device in claim 4, wherein the top wall includes indicia relating to a sponsor.

6. The device in claim 4, wherein the top wall is colored to differentiate the device from another device.

7. The device in claim 4, wherein the top and bottom walls have at least one curved side.

8. The device in claim 4, wherein the recessed portion includes an opening for coupling an item to the recessed portion and wherein the coupled item does not interfere with the curved groove when the curved groove is snapped onto the can lip.

9. The device in claim 8, wherein the recessed portion includes a channel that leads to the opening.

10. The device in claim 9, wherein:

the top wall has indicia relating to a sponsor;

the top wall is colored to differentiate the device from another device;

the top and the bottom walls have at least one curved side; and the device is constructed of at least one material selected from the group consisting of: plastic, wood, metal, and rubber.

11. The device in claim 2, wherein the curved groove is separated into two tabs with a relief in the middle.

12. A device for opening and closing a can having a top side with a tear panel for providing access to the contents of the can and a pull tab for rupturing the tear panel, the pull tab having front and back ends and being attached to the top side by a rivet that is closer to the back end than the front end; the pull tab back end initially being adjacent the tear panel, such that when the pull tab front end is lifted, the pull tab back end pushes the tear panel into the can, opening the can and forming a hole in the top side; the pull tab being rotatable around the rivet to allow the pull tab front end to rotate at least 180 degrees and selectively be upwardly adjacent the hole; the device comprising:

a top portion and a bottom portion forming a cavity therebetween; the bottom portion having an indentation complimentary to the rivet; the cavity having a front side, a back side, a first lateral side and a second lateral side;

an intermediate wall having a J-shaped cross-section; the intermediate wall having a proximal side and a distal side; the proximal side closing the first lateral side and the back side of the cavity; the proximal side partially closing the second lateral side of the cavity; the intermediate wall having a curved groove adjacent the distal side, the curved groove being configured to snap onto a lip of the can; and a recessed portion extending from the distal side of the intermediate wall;

wherein the cavity is configured to receive the pull tab front end;

wherein the bottom portion is configured to lift the pull tab front end when the pull tab front end is received in the cavity and the recessed portion is raised; and wherein the bottom portion and the intermediate wall are collectively configured to cover the can hole when the pull tab front end is upwardly adjacent the hole and the pull tab front end is received in the cavity.

13. The device in claim 12, wherein the curved groove has two tabs with a relief in the middle.

14. The device in claim 13, wherein:

the top portion has indicia relating to a sponsor; and the recessed portion has an opening with a channel for coupling an item to the recessed portion.

15. The device in claim 13, wherein the top and the bottom portions have at least one curved side.

16. The device in claim 14, wherein the bottom portion is beveled.

17. The device in claim 16, wherein the item coupled to the recessed portion does not interfere with the curved groove when the curved groove is snapped onto the can lip.

18. A device for opening a can having a top side with a tear panel for providing access to the contents of the can and a pull tab for rupturing the tear panel, the pull tab having front and back ends and being attached to the top side by a rivet that is closer to the back end than the front end; the pull tab back end being adjacent the tear panel, such that when the pull tab front end is lifted, the pull tab back end pushes the tear panel into the can, opening the can and forming a hole from which a beverage within the can may be consumed; the device comprising:

a top portion and a bottom portion forming a cavity therebetween; the cavity having a front side, a back side, a first lateral side and a second lateral side;

the bottom portion having an indentation complimentary to the rivet;

an intermediate wall having a J-shaped cross-section, and a proximal side and a distal side such that the proximal side closes the first lateral side and the back side of the cavity, and the proximal side partially closes the second lateral sick of the cavity; the intermediate wall having a curved groove; the curved groove configured to snap onto a lip of the can;

a recessed portion coupled to the intermediate wall;

wherein the cavity is configured to receive the pull tab front end;

wherein the bottom portion is configured to lift the pull tab front end when the pull tab front end is received in the cavity and the recessed portion is raised;

wherein the recessed portion is lower than the top portion to prevent a user from hitting the user's nose with the device when consuming the beverage within the can while the curved groove is snapped onto the can lip.

19. The device in claim 18 wherein:

the pull tab front end is rotatable around the rivet to allow the pull tab front end to rotate at least 180 degrees and be selectively upwardly adjacent to the hole; and the bottom portion and the intermediate wall are collectively configured to cover the can hole when the pull tab front end is upwardly adjacent the hole and the pull tab front end is received in the cavity.

* * * * *